US006364428B1

(12) United States Patent
Labriola et al.

(10) Patent No.: US 6,364,428 B1
(45) Date of Patent: Apr. 2, 2002

(54) APPARATUS FOR A QUICK RELEASE MECHANISM IN A RAILCAR HAND BRAKE

(75) Inventors: Angelo M. Labriola, Blue Island, IL (US); Everett G. Ring, Gary, IN (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 09/664,212

(22) Filed: Sep. 18, 2000

(51) Int. Cl.[7] ..... B60T 17/02

(52) U.S. Cl. ..... 303/13; 188/33; 188/107; 188/153 R; 74/523; 74/528; 74/505

(58) Field of Search ..... 303/7, 13, 14, 303/22.6, 22.7, 66, 89, 128; 188/107, 33, 153 R, 170, 265, 106 R; 74/89, 89.1, 528, 43, 148, 504, 523, 524–526, 536, 505

(56) References Cited

U.S. PATENT DOCUMENTS 3,668,944 A 6/1972 Natschke ..... 74/505
3,803,940 A * 4/1974 La Belle ..... 74/505
3,923,287 A * 12/1975 Weseloh et al. ..... 74/505 X
4,291,793 A * 9/1981 Klasing ..... 192/95
4,368,648 A * 1/1983 Housman et al. ..... 74/505
6,179,093 B1 * 1/2001 Daugherty, Jr. ..... 188/33

* cited by examiner

*Primary Examiner*—Pam Rodriguez
(74) *Attorney, Agent, or Firm*—James Ray & Associates

(57) ABSTRACT

An apparatus for a quick release mechanism in a railcar hand brake. The hand brake has a housing having a front casing with an inside wall of a predetermined size and shape, and a back plate. An operating shaft is rotatably mounted in the housing. The operating shaft includes a first end and a second end. The operating shaft further includes a ratchet wheel rotatable with the operating shaft intermediate the first and second ends thereof, and a release shaft rotatably mounted in the housing. The apparatus comprises a projection of a predetermined size and shape disposed substantially perpendicular to the ratchet wheel, and a flexible clamp of a predetermined size and shape mounted inside the housing. A member is disposed substantially perpendicular to, and about the circumference of the release shaft, having a first element disposed on the member wherein the first element interposes with the flexible clamp when the release shaft is rotated to achieve and maintain full brake release, and a second element disposed on the member and engageable with the projection when the operating shaft is rotated to disengage the first element from the flexible clamp to allow for brake application.

11 Claims, 3 Drawing Sheets

APPARATUS FOR A QUICK RELEASE MECHANISM IN A RAILCAR HAND BRAKE

CROSS-REFERENCE TO RELATED APPLICATION

The invention taught in the present application is closely related to the invention taught in co-pending patent application titled "Quick Release Mechanism For A Railcar Hand Brake", filed concurrently herewith and having Ser. No. 09/664,210. This application is assigned to the assignee of the present application. The teachings of this co-pending patent application are incorporated herein by reference thereto.

FIELD OF THE INVENTION

The present invention relates, in general, to a railcar hand brake, and more particularly, to an apparatus for a quick release mechanism in a railcar vertical wheel hand brake. The present invention will maintain a hand brake in the released position until an application is made.

BACKGROUND OF THE INVENTION

Prior to the present invention, a railcar vertical hand brake includes a brake release mechanism that provides quick release of the brakes by disengaging the winding gear to permit free rotation of the main gear wheel. A force is exerted on the release lever to move the attached brake release shaft, whereby releasing the main gear wheel and the tension on the brake chain, which in turn releases the brake. When the force on the release lever is removed, the main gear wheel re-engages. However, the brake may not be fully released. When a railcar negotiates a curve in the track, the truck rotates and can exert a force on the brake chain. The chain resists the truck movement and tends to pull on the hand brake lever. This action can apply the brakes to the truck while the train is in motion. Friction and wear between the brake shoes and the wheels, and the wheels and the rail may occur as a result.

An example of this type hand brake is taught in U.S. Pat. No. 3,668,944, and the Universal 7400 Model Hand Brake. The teachings of these references are incorporated herein by reference thereto.

SUMMARY OF THE INVENTION

In a first aspect, the present invention provides an apparatus for a quick release mechanism in a railcar hand brake having a housing. The housing has a front casing with an inside wall of a predetermined size and shape, a back plate, and an operating shaft rotatably mounted in the housing, including a first end, a second end, and a ratchet wheel rotatable with the operating shaft intermediate of the first and second ends. A release shaft is rotatably mounted in the housing. The quick release mechanism comprises a projection of a predetermined size and shape disposed substantially perpendicular to the ratchet wheel, and a flexible clamp of a predetermined size and shape mounted inside the housing. A member is disposed substantially perpendicular to and about the circumference of the release shaft. A first element is disposed on such member wherein the first element interposes with the flexible clamp when the quick release shaft is rotated to achieve and maintain full brake release, and a second element is disposed on such member and engageable with the projection disposed on the ratchet wheel when the operating shaft is rotated to disengage the first element from the flexible clamp to allow for brake application.

In a further aspect, the present invention provides for a combination with a railcar hand brake having a brake chain, brake drum, gear mechanism, ratchet device further including a ratchet wheel, clutch device, quick release mechanism, and a housing adapted for mounting on a railcar. The improvement comprises a projection of a predetermined size and shape disposed substantially perpendicular to the ratchet wheel, and a flexible clamp of a predetermined size and shape mounted inside the housing. A member is disposed perpendicular to and about the circumference of the release shaft, with a first element disposed on said member wherein the first element interposes with the flexible clamp when the release shaft is rotated to achieve and maintain full brake release, and a second element disposed on said member and engageable with the projection when the operating shaft is rotated to disengage the first element from the flexible clamp to allow for brake application.

In a further aspect, the present invention provides an apparatus for a quick release mechanism in a railcar hand brake having a housing. The quick release mechanism comprises a release shaft of a predetermined size and shape rotatably mounted in the housing. The release shaft has a first end, and the first end includes a cavity of a predetermined size and shape. A release lever has a hub with an inside diameter which is journaled on the first end of the release shaft. A stop of a predetermined size and shape is disposed on the inside diameter of the hub of the release lever, and is engageable with the cavity of the release shaft to rotate the release shaft and cause free quick release of the brake.

In still a further aspect, the present invention provides for a combination with a railcar hand brake having a brake chain, brake drum, gear mechanism, ratchet device further including a ratchet wheel, clutch device, quick release mechanism, and a housing adapted for mounting on a railcar. The improvement comprises a release shaft of a predetermined size and shape rotatably mounted in the housing. The release shaft has a first end, the first end including a cavity of a predetermined size and shape. A release lever has a hub with an inside diameter which is journaled on the first end of the release shaft. A stop of a predetermined size and shape is disposed on the inside diameter of the hub of the release lever, and is engageable with the cavity of the release shaft to rotate the release shaft and cause free quick release of the brake.

OBJECTS OF THE INVENTION

It is therefore a primary object of the present invention to provide an apparatus for maintaining a railcar hand brake quick release mechanism in the full release position until brake application is made.

Another object of the present invention is to increase railcar wheel life by reducing the premature wear between the railcar brakes and the wheels as a result of friction between the brakes and the wheels due to unintentional brake application during train operation.

Still a further object of the present invention is to increase railway track life by reducing the friction between the wheels and the track as a result of restriction of rolling movement of the wheels on the track due to unintentional brake application during train operation.

Still a further object of the present invention is to minimize the potential for the quick release handle to remain extended into the path of the railcar ladder by allowing the release lever to freely return to the original position while maintaining full brake release.

In addition to the various objects of the invention that have been described above, various other objects and advantages of the invention will become more readily apparent to those persons skilled in the relevant art from the following more detailed description of the invention, particularly, when such description is taken in conjunction with the attached drawing figures and the appended claims.

Figure 1:
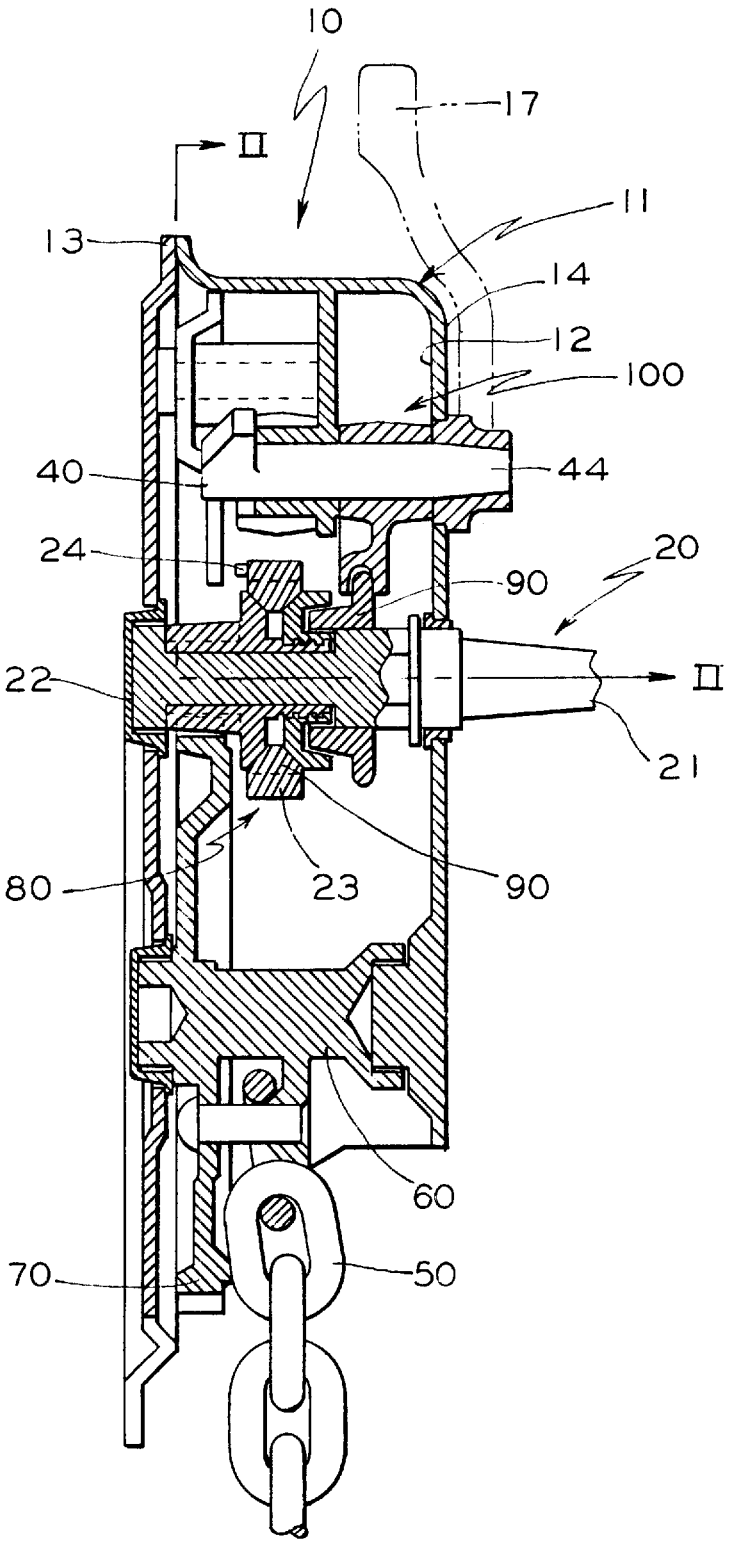
FIG. 1 is a side sectional view of a railcar vertical hand brake of the present invention.

BRIEF DESCRIPTION OF A PRESENTLY PREFERRED AND VARIOUS ALTERNATIVE EMBODIMENTS OF THE PRESENT INVENTION

Prior to preceding to a more detailed description of the invention, it should be noted that identical components having identical functions have been designated with identical reference numerals for the sake of clarity.

Figure 2:
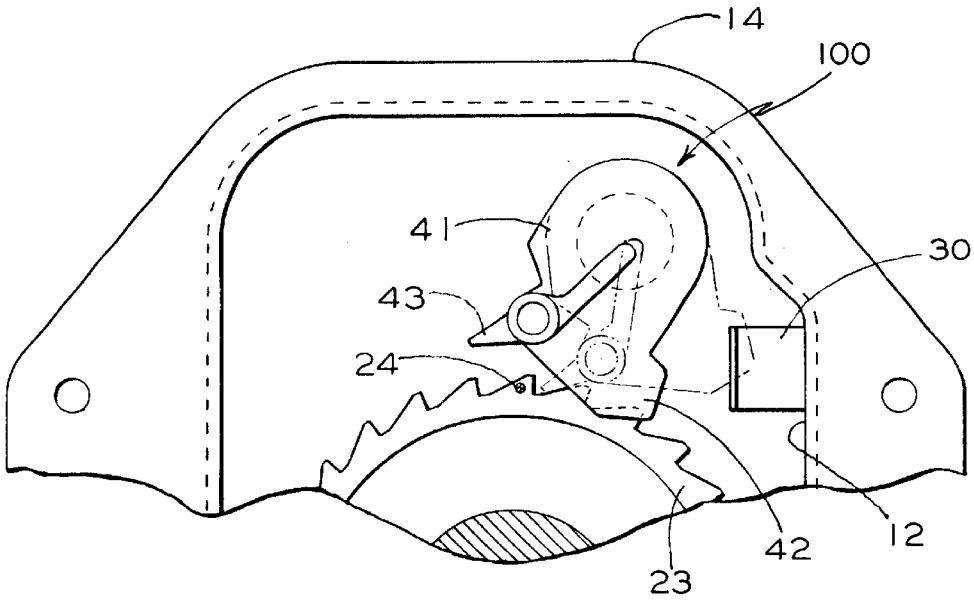
FIG. 2 is a front sectional view taken along the lines II—II of FIG. 1.
Figure 3:
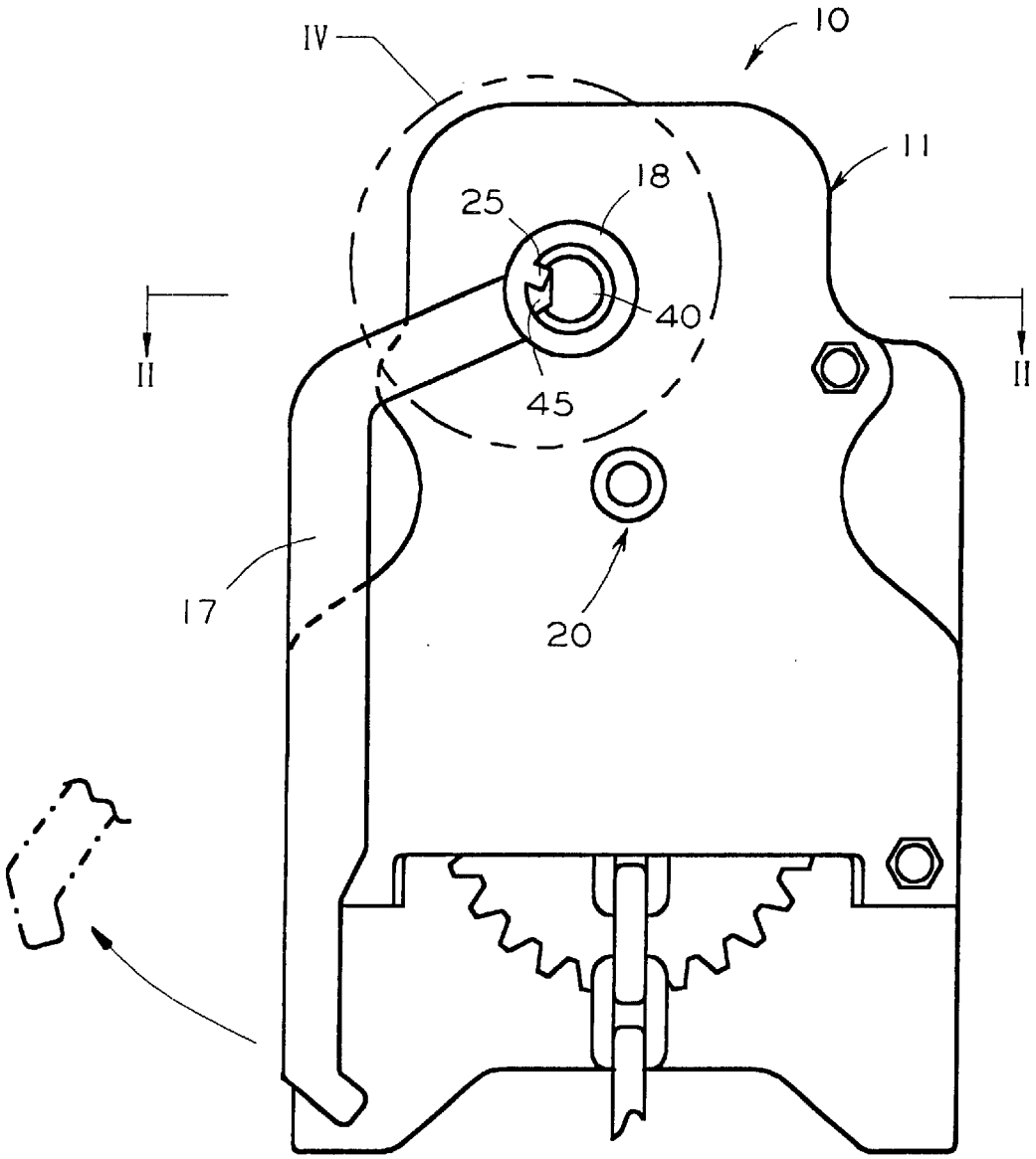
FIG. 3 is a front elevational view of a railcar vertical hand brake of the present invention.

Now refer more particularly to FIGS. 1 2, and 3 of the drawings. Illustrated therein is an apparatus for a quick release mechanism in a railcar hand brake. The railcar hand brake, generally designated 10, has a housing, generally designated 11. The housing comprises a front casing 14 including an inside wall 12 of a predetermined size and shape, and a back plate 13. An operating shaft, generally designated 20 is rotatably mounted in the housing 11. The operating shaft 20 includes a first end 21 and a second end 22. A ratchet wheel 23 is rotatable with the operating shaft 20 and intermediate the first end 21 and second end 22. A release shaft 40 is rotatably mounted in the housing 11.

The apparatus comprises a projection 24 of a predetermined size and shape disposed substantially perpendicular to the ratchet wheel 23. Preferably, the projection 24 is a pin of a predetermined length and diameter. A flexible clamp 30 of a predetermined size and shape is mounted inside the housing 11. Preferably, the flexible clamp 30 is a clevis shaped spring clip that is mounted on the inside wall 12 of the front casing 14. A member 41 is disposed substantially perpendicular to, and about the circumference of the release shaft 40. A first element 42 is disposed on the member 41. When full brake release is desired throughout train movement, the release shaft 40 is rotated. The first element 42 interposes with the flexible clamp 30, whereby the flexible clamp 30 secures the first element 42. A second element 43 is disposed on the member 41. When brake application is desired, the operating shaft 20 is rotated in such a direction to move the projection 24 on the ratchet wheel 23 into engagement with the second element 43, causing the release shaft 40 to rotate, which disengages the first element 42 from the flexible clamp 30. Preferably, the first element 42 is a lobe shaped protrusion of a predetermined size, and the second element 43 is a tapered protrusion of a predetermined size.

Now refer more particularly to FIGS. 1, 2, and 3 of the drawings. The improvement is shown in combination with a railcar hand brake 10 having a brake chain 50, brake drum 60, gear mechanism 70, ratchet device, generally designated 80 including a ratchet wheel 23, a clutch device 90, a quick release mechanism generally designated 100, and a housing 11 adapted for mounting on a railway car. The improvement comprises a projection 24 of a predetermined size and shape disposed substantially perpendicular to the ratchet wheel 23. Preferably, the projection 24 is a pin of a predetermined length and diameter. The combination further includes a flexible clamp 30 of a predetermined size and shape mounted inside said housing. Preferably, the flexible clamp 30 is a clevis shaped spring clip, and is mounted on the inside wall 12 of the front casing 14. A member 41 is disposed substantially perpendicular to, and about the circumference of the release shaft 40. A first element 42 is disposed on the member 41. When full brake release is desired for train movement, the release shaft 40 is rotated. The first element 42 interposes with the flexible clamp 30, whereby the flexible clamp 30 secures the first element 42. A second element 43 is disposed on the member 41. The first element 42 interposes with the flexible clamp 30, whereby the flexible clamp 30 secures the first element 42. A second element 43 is also disposed on the member 41. When brake application is desired, the operating shaft 20 is rotated in such a direction to move the projection 24 on the ratchet wheel 23 into engagement with the second element 43, rotating the release shaft 40, which disengages the first element 42 from the flexible clamp 30 to allow for brake application.

Preferably, the first element 42 is a lobe shaped protrusion of a predetermined size, and the second element 43 is a tapered protrusion of a predetermined size.

Figure 4:
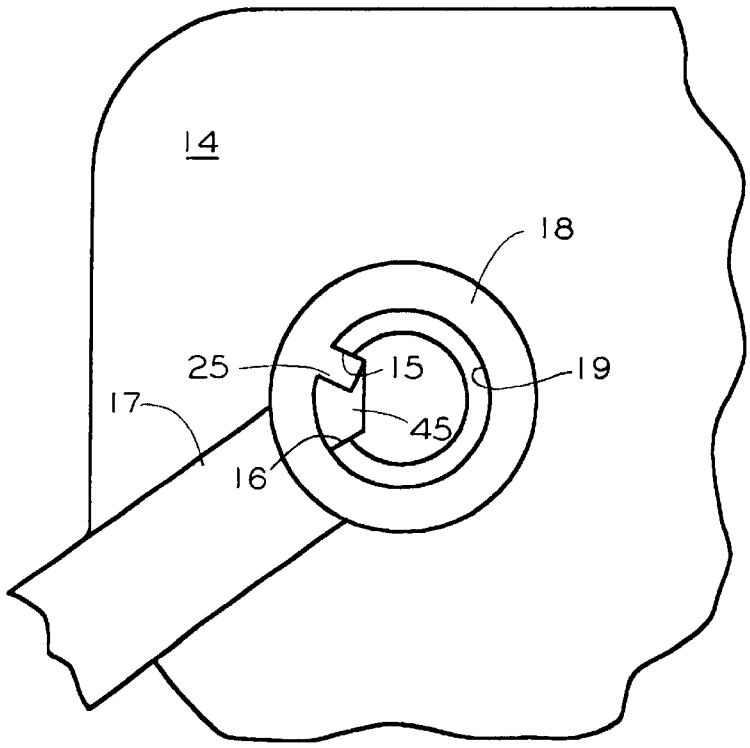
FIG. 4 is a detailed view of a section taken from the front elevational view of FIG. 3.

Now refer more particularly to FIGS. 1, 3, and 4 of the drawings. Illustrated herein is an apparatus for a quick release mechanism in a railcar hand brake. The railcar handbrake, generally designated 10, has a housing, generally designated 11. The apparatus comprises a release shaft 40 of a predetermined size and shape rotatably mounted in the housing 11. The release shaft 40 has a first end 44. Preferably, the shape of the first end 44 of the release shaft 40 is substantially cylindrical. The first end 44 includes a cavity 45 of a predetermined size and shape. Preferably, the cavity 45 is a notch disposed on the circumference of and longitudinally along the axis of the release shaft 40, having a first surface 15 and a second surface 16. A release lever 17 having a hub 18 with an inside diameter 19 is journaled on the first end 44 of the release shaft 40. A stop 25 of a predetermined size and shape is disposed on the inside diameter 19 of the hub 18 of the release lever 17. The stop 25 is engageable with the cavity 45 of the Fang release shaft 40 to rotate the release shaft 40 and cause free quick release of the brake. Preferably, the stop engages with the first surface 15 of the cavity 45 when the release lever 17 is moved to activate the quick brake release mechanism. After full brake release is completed, the cavity 45 allows the release lever 17 to return to the lower position of FIG. 1, independent of the release shaft 40, which remains in the full brake release position.

Now refer more particularly to FIGS. 1,2,3, and 4 of the drawings. The improvement is shown in combination with a railcar hand brake 1 having a brake chain 50, brake drum 60, gear mechanism 70, ratchet device, generally designated 80 including a ratchet wheel 23, a clutch device 90, a quick release mechanism generally designated 100, and a housing 11 adapted for mounting on a railway car. The improvement comprises a release shaft 40 of a predetermined size and shape rotatably mounted in the housing 11. The release shaft

40 has a first end 44. Preferably, the shape of the first end 44 of the release shaft 40 is substantially cylindrical. The first end 44 includes a cavity 45 of a predetermined size and shape. Preferably, the cavity 45 is a notch disposed on the circumference of and longitudinally along the axis of the release shaft 40, having a first surface 15 and a second surface 16. A release lever 17 having a hub 18 with an inside diameter 19 is journaled on the first end 44 of the release shaft 40. A stop 25 of a predetermined size and shape is disposed on the inside diameter 19 of the hub 18 of the release lever 17. Preferably, the stop engages with the first surface 15 of the cavity 45 when the release lever 17 is moved to activate the quick brake release mechanism. After full brake release is completed, the cavity 45 allows the release lever 17 to return to the lower position of FIG. 1, independent of the release shaft 40, which remains in the full brake release position.

Although the invention has been shown in connection with a certain specific embodiment, it will be readily apparent to those skilled in the art that various changes in form and arrangement of parts and method may be made to suit requirements without departing from the spirit and scope of the invention.

We claim:

1. An apparatus for a quick release mechanism in a railcar hand brake having a housing, said housing having a front casing with an inside wall of a predetermined size and shape, a back plate, an operating shaft rotatably mounted in said housing, said operating shaft including a first end and a second end and further including a ratchet wheel rotatable with said operating shaft intermediate said first and second ends thereof, and a release shaft rotatably mounted in said housing; said apparatus comprising:

a. a projection of a predetermined size and shape disposed substantially perpendicular to said ratchet wheel;

b. a flexible clamp of a predetermined size and shape disposed inside said housing;

c. a member disposed substantially perpendicular to and about the circumference of said release shaft;

d. a first element disposed on said member wherein said first element interposes with said flexible clamp when said release shaft is rotated to achieve and maintain full brake release; and e. a second element disposed on said member and engageable with said projection when said operating shaft is rotated to disengage said first element from said flexible clamp to allow for brake application.

2. The apparatus according to claim 1 wherein said projection is a pin of a predetermined length and diameter.

3. The apparatus according to claim 1 wherein said flexible clamp is adapted to be mounted on said inside wall of said front casing.

4. The apparatus according to claim 1 wherein said flexible clamp is a clevis shaped spring clip.

5. The apparatus according to claim 1 wherein said first element is a lobe shaped protrusion of a predetermined size.

6. The apparatus according to claim 1 wherein said second element is a tapered protrusion of a predetermined size.

7. In combination with a railcar a hand brake having a brake chain, brake drum, gear mechanism, ratchet device, said ratchet device further including a ratchet wheel, clutch device, quick release mechanism, and a housing adapted to be mounted on such railcar, the improvement comprising:

a. a projection of a predetermined size and shape disposed substantially perpendicular to said ratchet wheel;

b. a flexible clamp of a predetermined size and shape mounted inside said housing;

c. a member disposed substantially perpendicular to and about a circumference of a release shaft;

d. a first element disposed on said member wherein said first element interposes with said flexible clamp when said release shaft is rotated to achieve and maintain full brake release; and e. a second element disposed on said member and engageable with said projection when an operating shaft is rotated to disengage said first element from said flexible clamp to allow for brake application.

8. The combination according to claim 7 wherein said projection is a pin of a predetermined length and diameter.

9. The combination according to claim 7 wherein said flexible clamp is mounted on an inside wall of a front casing of said housing.

10. The combination according to claim 7 wherein said first element is a lobe shaped protrusion of a predetermined size, and said second element is a tapered protrusion of a predetermined size.

11. The combination according to claim 7 wherein said flexible clamp is a clevis shaped spring clip.

* * * * *